United States Patent [19]

Vernelson et al.

[11] Patent Number: 4,669,684

[45] Date of Patent: Jun. 2, 1987

[54] SCULPTURED BIRD KITE

[76] Inventors: Walter M. Vernelson; Karen S. Murphy, both of 1084 Ironwood Dr., Grayson, Ga. 30221

[21] Appl. No.: 914,366

[22] Filed: Oct. 2, 1986

[51] Int. Cl.[4] ..... B64C 31/06

[52] U.S. Cl. ..... 244/153 R

[58] Field of Search ..... 244/153 R, 154; D21/83, D21/88

[56] References Cited

U.S. PATENT DOCUMENTS

| | | | |
|---|---|---|---|
| 743,301 | 11/1903 | Lischtiak | D21/88 |
| 2,762,590 | 9/1956 | Huie | 244/153 R |
| 4,168,816 | 9/1979 | Acosta | 244/154 |
| 4,228,977 | 10/1980 | Tanaka | 244/153 R |

OTHER PUBLICATIONS

The Evening Star, "Smithsonian's Carnival of Kites to Bedeck Skies Over Mall", Washington, D.C., Feb. 24, 1968, p. A20.

*Primary Examiner*—Joseph F. Peters, Jr.
*Assistant Examiner*—Rodney Corl

[57] ABSTRACT

An aerodynamically sculptured kite that can realistically portray virtually all species of flying birds as well as other flying things. This sculptured bird kite as closely as possible accurately describes both the visual and flight characteristics of the bird portrayed. It is comprised of a rigid central body, a pair of covered wing assemblies, a covered tail assembly which can move about an axis, a footed leg assembly and an adjustable harness assembly; all assemblies having been designed to be easily attached to and detached from the central body.

8 Claims, 8 Drawing Figures

SCULPTURED BIRD KITE

BACKGROUND OF THE INVENTION

1. FIELD OF THE INVENTION

An aerodynamically sculptured bird kite that realistically depicts, as closely as possible, both the visual and flight characteristics of the bird portrayed when tethered to a main flight line.

2. DESCRIPTION OF THE PRIOR ART

It became apparent upon researching for design precedents that the sort of kite imagined was nonexistent; therefore the only point of reference for this kite was an actual soaring bird. The bird used as the standard for this invention was the vulture.

SUMMARY OF THE INVENTION

The primary object of this invention was to successfully design and construct a sculptured bird kite portraying the artistic beauty of a carved decoy while utilizing aerodynamic components, which when assembled and tethered to a main flight line, would look like and soar like the chosen bird portrait.

Another object of this invention was to construct the sculptured kite around a three dimensional longitudinally extending central body. By incorporating mounting devices the central body would serve as the platform for mounting a pair of wing assemblies, a tail assembly, a leg assembly, and a harness assembly.

Another object of this invention was to design the wings around a rigid curved primary wing frame which would utilize the essence of the aerodynamic features of the leading edge of an actual bird wing. A rigid fillet incorporating mounting projections would be attached perpendicular to the primary wing frame such that the mounting projections could be removably press fit into the wing mount sockets of the central body. The shape of the wing would be further defined by incorporating a flexible removably fit trailing edge.

The tail assembly would pivot about a hinge mechanism and be held in a flight position by an elastic member to provide flexibility. The leg assembly would serve as agents for counterbalance, center of gravity, landing and as a hookup point for the harness assembly.

In conjunction with the above objects, another evolved, the invention would incorporate fabric wing and tail covers, each cover being constructed like a fitted pillowcase and having an elasticized open end to insure a snug fit when pulled over the respective assembly.

Another object of this invention was to utilize a harness assembly incorporating a fulcrum which would mechanically fix the attack angle of the kite and an elasticized member at the aft end of the harness to provide flexibility.

Still another object of this invention was that the kite components would be easy to assemble and disassemble.

Another object of this invention was that wind conditions for flight would be the same as for other types of kites.

A final object was that the kite would be as enjoyable to watch as it would be to actually fly.

DESCRIPTION OF THE PREFERRED EMBODIMENT

The original intent was to design a three dimensional kite 20 which looked like and flew like a real bird. The aerodynamic features of this kite 20 as illustrated below demonstrate a universality of design which not only fulfills the original intent; but accommodates virtually any embodiment as long as weight, aerodynamic shape and balance criteria are observed.

Figure 1:
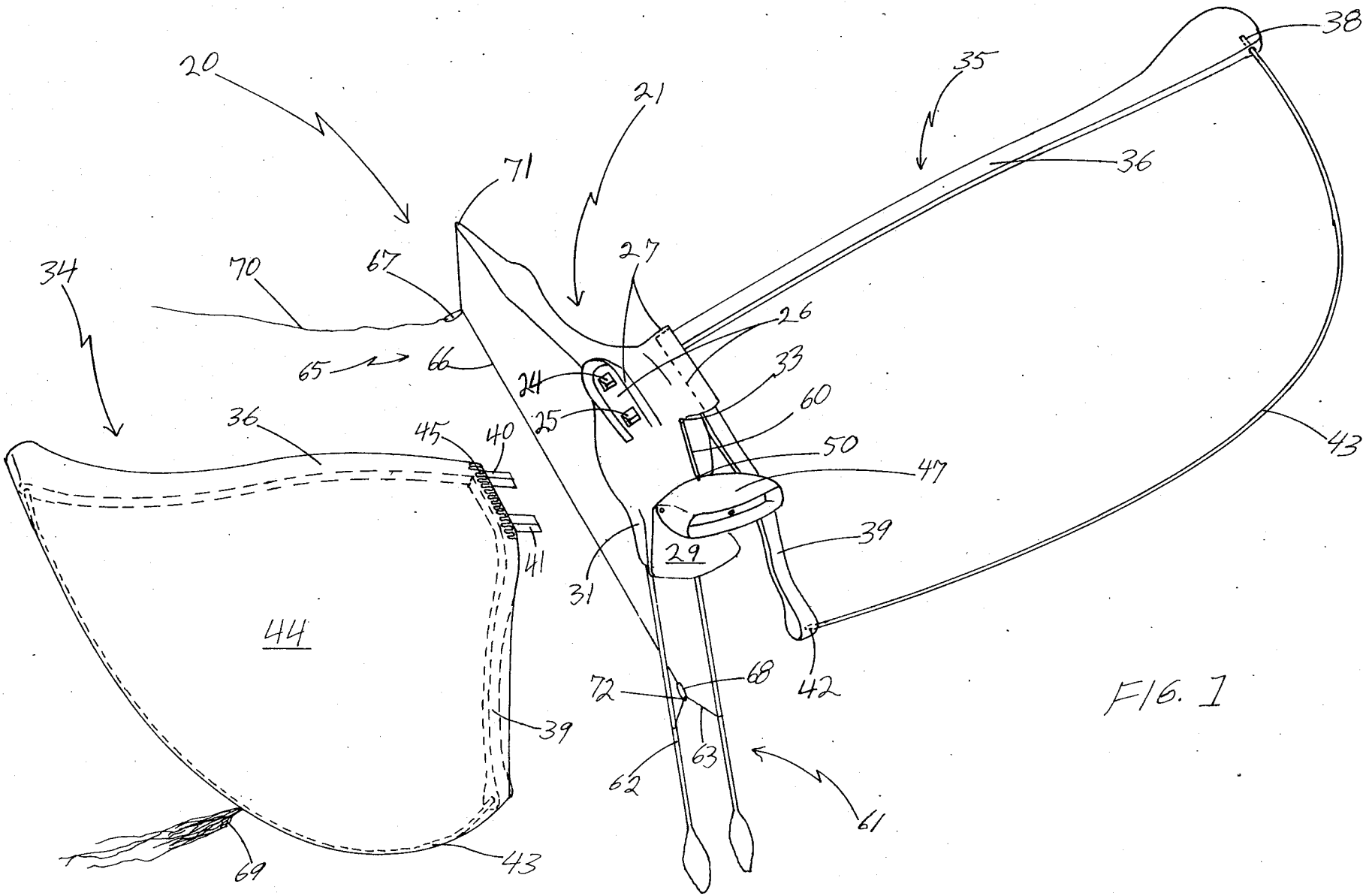
FIG. 1. A general three quarter view of the kite with an exploded view of a covered wing assembly and just the hinged components of the tail assembly.

The Murphy/Peeler kite 20, hereafter referred to as the M/P kite 20, is a three dimensional modular design which comprises a central body 21, a pair of wings 34, a tail assembly 46, a leg assembly 61, and a harness assembly 65 as illustrated in FIG. 1.

When the embodiment of the M/P kite 20 has been decided upon (a Japanese Crane in this case), the first order of construction is deciding the posture (profile) of the central body 21.

Figure 2:
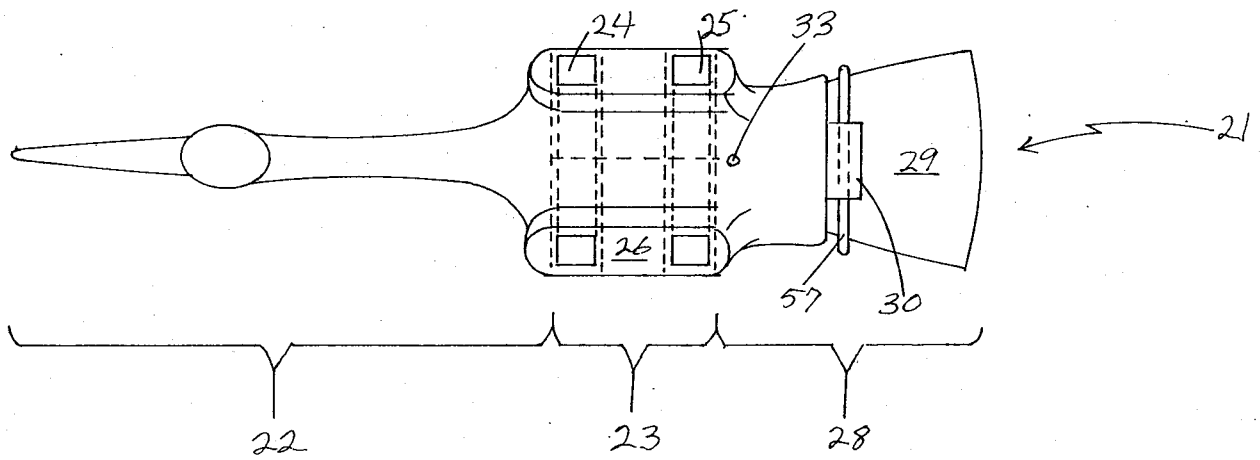
FIG. 2. A top diagramatic view of the kite body illustrating the wing mount sockets and the flat tail plane.

The central body 21 is divided into a front body section 22, a mid body section 23, and an aft body section 28 as illustrated in FIG. 2. The impetus of the central body 21 and thus the fully assembled M/P kite 20 is the mid body section 23. This section has two essential functions. First it houses two pairs of wing mount sockets 24 and 25 and their attendant structure and second, it provides for the establishment for both the front body section 22 and the aft body section 28.

The front body section 22 extends from the most forward point of the central body 21 (in the case of a bird embodiment, the beak) rearward along the longitudinal axis to the forward wing mount sockets 24 of the mid body section 23. The front body section 22 incorporates a hookup point 71 for the harness assembly 65 and provides the primary artistic visual reference for the assembled M/P kite 20.

Figure 3:
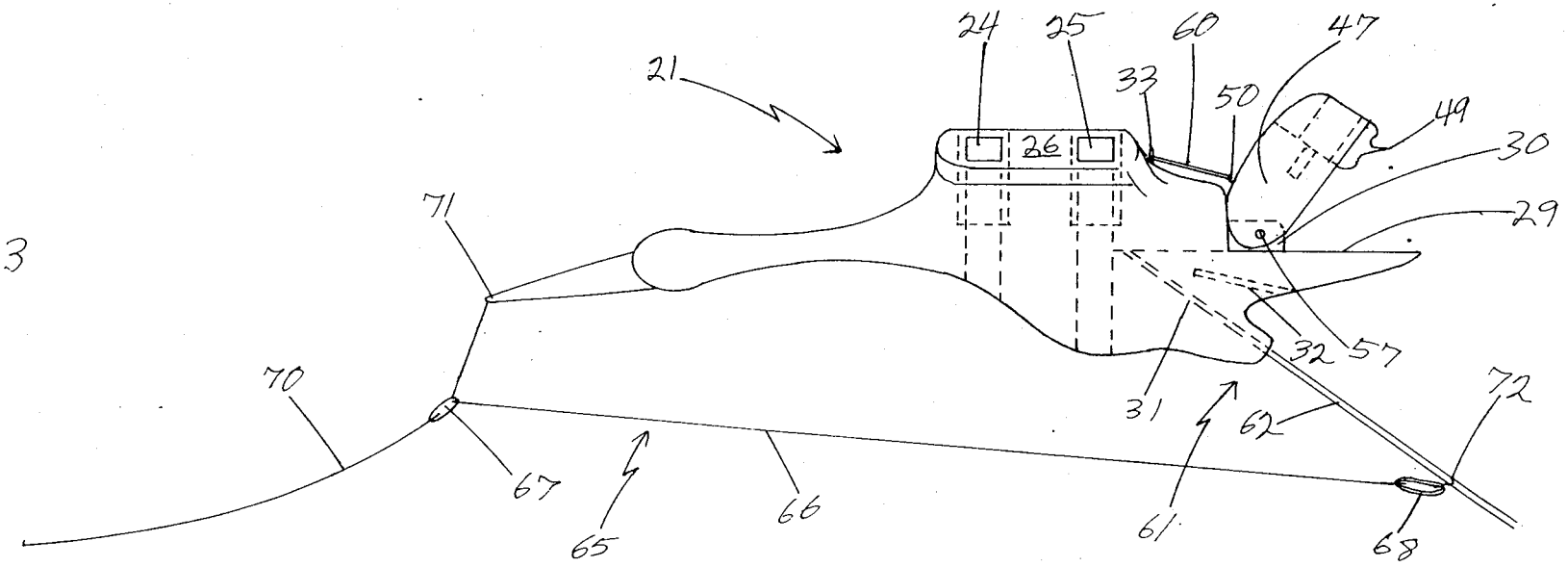
FIG. 3. A side view of the kite body illustrating the wing mount sockets, the hinged components of the tail assembly, the leg assembly and the harness assembly.

The aft body section 28 extends rearward along the longitudinal axis of the central body 21 from the rear wing mount sockets 25 of the mid body section 23 to the extreme rear point of the central body 21. The aft body section 28 incorporates a flat tail plane surface 29, a stationary male hinge part 30, two leg mount sockets 31, a counterbalance socket 32, and a fastening mechanism 33 as illustrated in FIG. 3. The leg mount sockets 31, their location and angle into the aft body section 28 are determined by the embodiment portrayed as well as with balance and center of gravity requirements. The flat tail plane surface 29, the male hinge part 30, the fastening mechanism 33, and the counterbalance socket 32 will be discussed in more detail below.

After determining the central body 21 profile, the location of the wing mount sockets 24 and 25 must be established; they are located on the mid body section 23 as illustrated in FIGS. 1, 2 and 3 and are essentially dictated by the embodiment portrayed.

Figure 5:
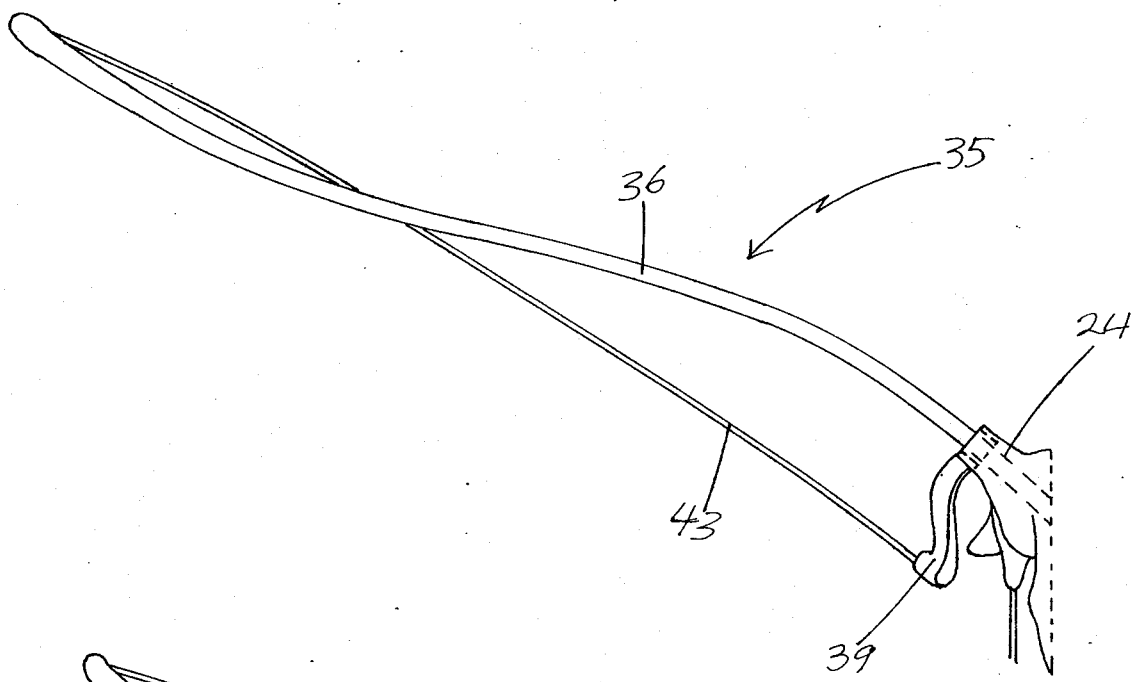
FIG. 5. A front fragmentary view of an installed wing frame assembly illustrating the maximum recommended wing mount socket angle and the primary wing frame curve and countercurve.
Figure 6:
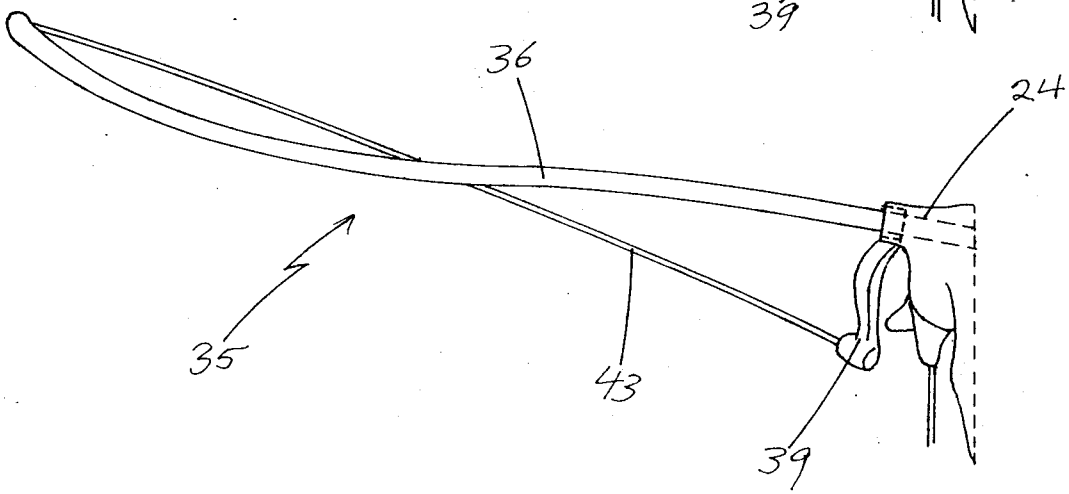
FIG. 6. Another front fragmentary view of an installed wing frame assembly illustrating the minimum recommended wing mount socket angle.

There are four wing mount sockets; two on the right side and two on the left side of the mid body section 23 as illustrated in FIG. 2. The first pair of wing mount sockets 24 are located at shoulder level at the foward end of the mid body section 23 such that they are perpendicular to the longitudinal axis of the central body 21. Further they extend into the mid body section 23 at an angle to a point on the vertical axis as shown in FIGS. 5 and 6. This angle has a recommended range of between ten degrees and forty degrees from the horizontal axis. The aft wing mount sockets 25 are located at a position a variable distance rearward of the forward wing mount sockets 24 at exactly the same angle and elevation. The left side wing mount sockets are mirror images to the right side wing mount sockets.

A flat planar surface is established at shoulder level on each side of the mid body section 23 by the forward 24 and rearward 25 wing mount sockets. This surface as shown in FIGS. 2 and 3 is a flat shoulder plane 26 and is the focal point when the attack angle of the M/P kite 20 is discussed.

Figure 7:
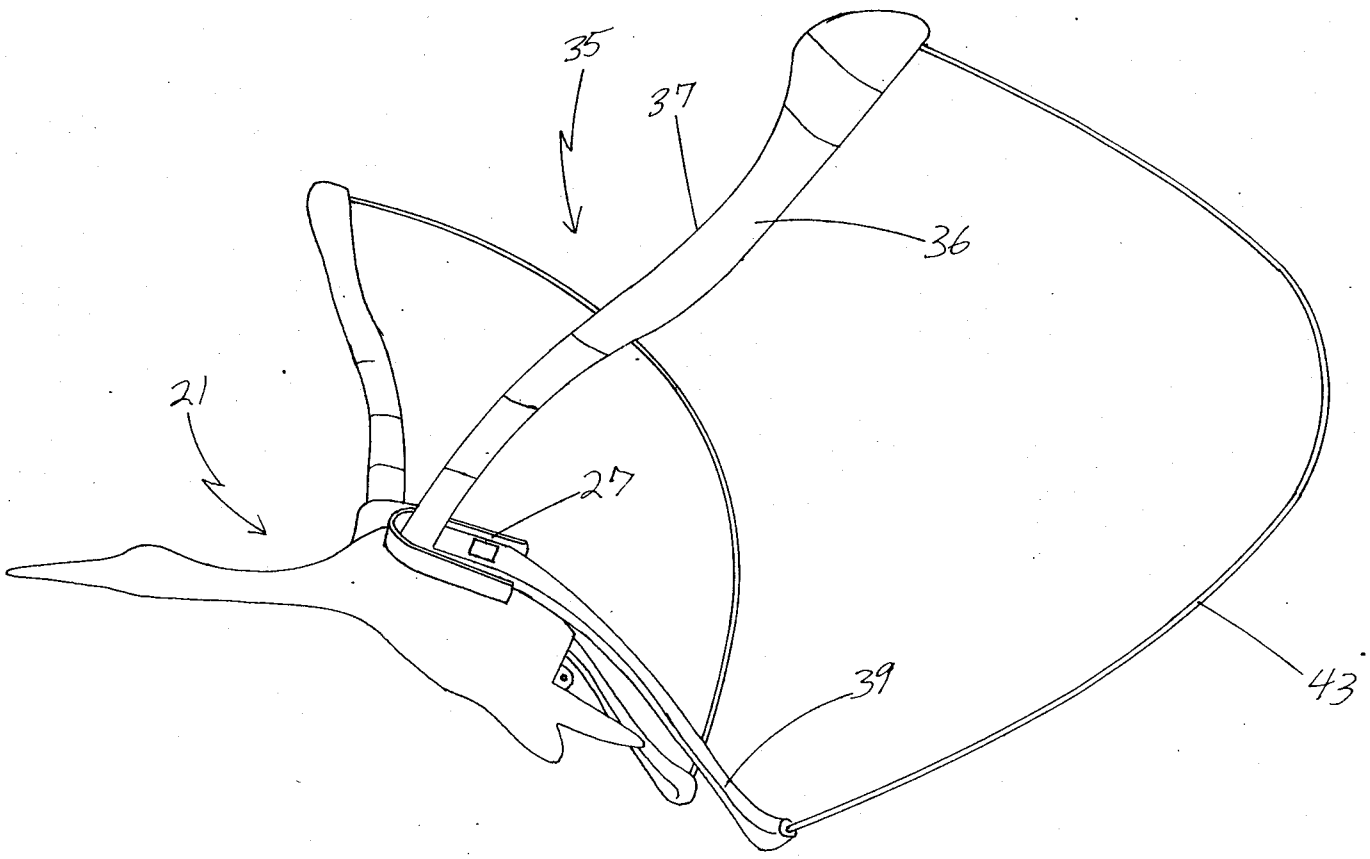
FIG. 7. A fragmentary three quarter view illustrating the aerodynamic features of the kite body and the wing frame assemblies.

Extending outward approximately one inch and parallel to the wing mount sockets 24 and 25 on each side of the mid body section 23 is a collar 27 as illustrated in FIGS. 1 and 7. The collar 27 starts at the top aft end of the rear wing mount socket 25, extends forward and around the flat shoulder plane 26, then rearward until it stops at the lower aft end of the rear wing mount socket 25. The collar 27 mechanically shapes the fabric wing cover 44, helps to reduce drag, provides minor lift and aids in the smooth transition between the central body 21 and the wing 34.

When the angle of the wing mount sockets 24 and 25, relative to the horizontal axis of the central body section 21 is determined, the curve and length of the primary wing frame 36 can be set. The length of the primary wing frame 36 is dependent upon the physical characteristics of the embodiment portrayed. The curves are dependent upon the angle of the wing mount sockets 24 and 25 relative to the horizontal axis of the central body 21 as shown in FIGS. 5 and 6.

The primary wing frame 36 must be shaped such that when wing mounting projections 40 and 41 are inserted into the wing mount sockets 24 and 25, it progressively curves in an ascending fashion relative to the horizontal axis. Approximately halfway along the length of the primary wing frame 36, a gradual countercurve is initiated and continues to the outward end of the primary wing frame 36 as shown in FIGS. 5, 6 and 7. The shape of the leading edge 37 to its approximate midpoint area, as shown in FIG. 7 on the primary wing frame 36, conforms to the aerodynamic principles of a standard airfoil leading edge. From that approximate midpoint, a gradual inversion is initiated which coincides with the primary wing frame 36 countercurve as shown in FIG. 7.

Physically the wing frame assembly 35 is comprised of three components. The first is the primary wing frame 36 which is attached to a fillet 39 as shown in FIG. 1. The fillet 39 is a rigid member attached at the base end and perpendicular to the primary wing frame 36. Emerging parallel to the primary wing frame 36 and protruding through the fillet 39 towards the mid body section 23 are two mounting projections 40 and 41. The front projection 40 is fashioned to be inserted into the front wing mount socket 24 and the aft projection 41 is situated in a straight line rearward along the fillet 39 and located for insertion into the aft wing mount socket 25 as shown in FIG. 1. The fillet 39 from that point then follows the natural curve and contour parallel to the kite 20 embodiment's longitudinal axis approximately three to six inches beyond the aft end of the central body 21. At the outward end and to the rear of the primary wing frame 36 is a socket 38. At the extreme aft end of the outward facet of the fillet 39 is a socket 42. These sockets accommodate the flexible and removable precurved trailing edge dowell 43. This embodiment employs a five thirty second inch diameter bass wood dowell approximately thirty six inches in length. When the ends of the flexible trailing edge dowell 43 are installed into their respective sockets 38 and 42 a straight line is established.

The installation of the trailing edge dowell 43 also establishes the wing area shape. This embodiment has an average leading edge thickness of one half inch, a wing length of twenty eight inches, and an average chord length of thirteen and one half inches. With embodiments whose portrayal require a higher aspect ratio (seagulls, albatroses, etc.) appropriate leading edge thickness and shape manipulations can be accomplished in order to accommodate better lift capabilities.

The next part is the fabric wing cover 44. It is essentially a removable pillowcase which is shaped to fit the wing frame assembly 35. Any lightweight fabric such as silk or silk like fabric can be used. The fabric wing cover 44 is pulled over the outward end of the wing frame assembly 35 to the fillet 39 where the open end 45 of the cover 44 has been elasticized to secure a snug fit around the fillet 39.

The ends of the flexible trailing edge dowell 43 fit easily into their appropriate sockets 38 and 42 and are inserted approximately one half inch at which distance they are mechanically stopped. When the fabric wing cover 44 is pulled over the wing frame assembly 35 and the elasticized open end 45 of the cover 44 is fitted around the fillet 39, the fabric wing cover 44 conforms to the primary wing frame 36 airfoil configuration. The fit of the wing cover 44 is such that the trailing edge dowell 43 is held in place by the installed wing cover 44 but not to the extent that flexibility of the trailing edge 43 is compromised. When the wing 34 is inserted into the wing mount sockets 24 and 25, the lower edge of the fabric wing cover 44 is mechanically shaped by the wing socket collar 27 to conform to the shape of the fillet 39 as shown in FIG. 7.

When the wing 34 encounters the forces of the wind, the wing cover 44 assumes the shape of an airfoil. The restraints which allow limited flexibility of the trailing edge dowell 43 and hold the wing frame assembly 35 intact also act to control the ballooning effect of the wing cover 44; as such a tauntness of the upper and lower wing cover 44 surfaces is accomplished while at the same time not impeding the necessary ebb and flow of the wing cover 44 to accommodate the endless variations of wind dynamics.

Figure 8:
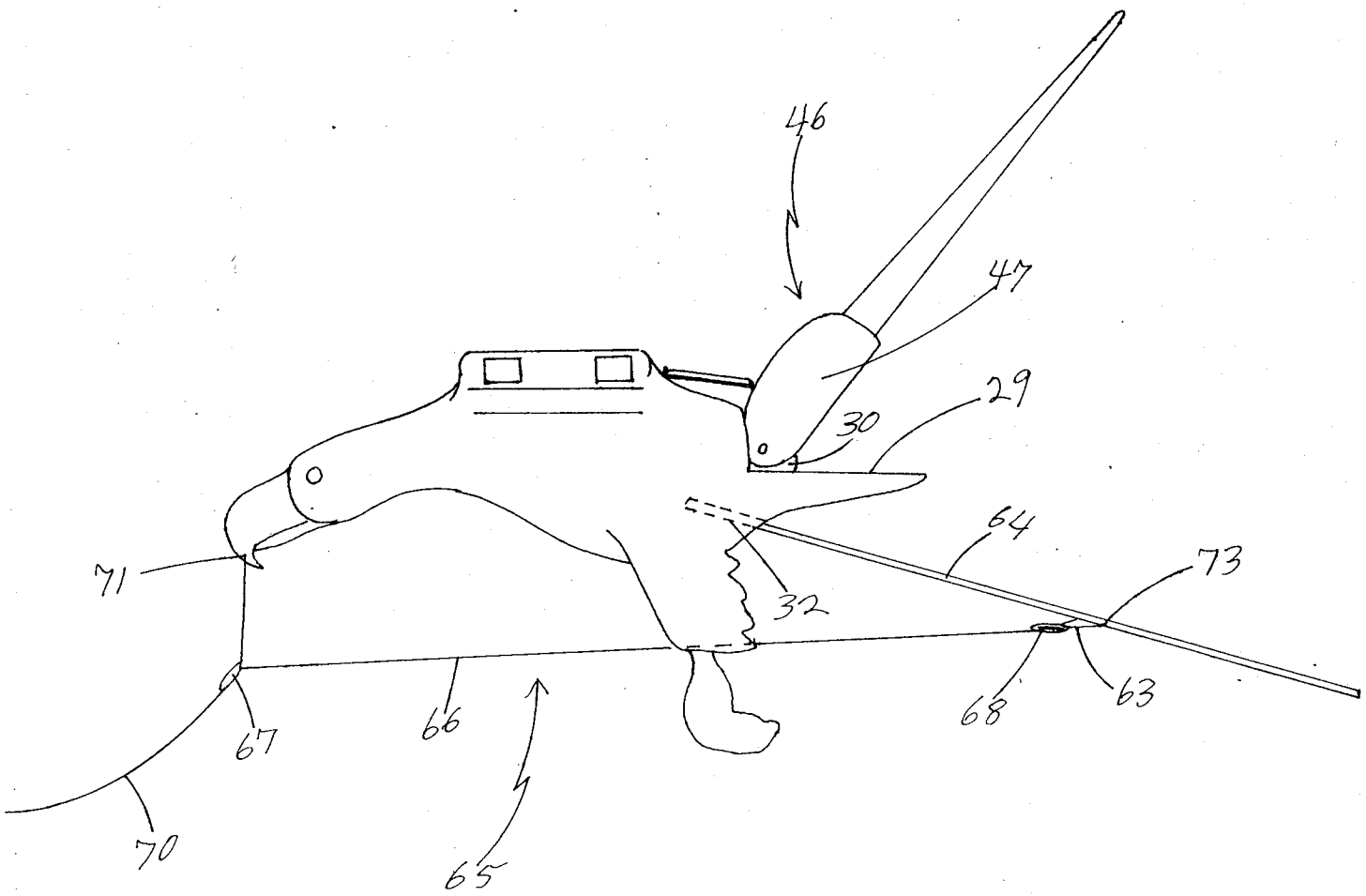
FIG. 8. A side view of a short legged embodiment illustrating the relationship of the counterbalance to the kite body and the harness assembly.

The tail plane 29 starts at an approximate midpoint on the longitudinal axis of the upper aft body section 28 as shown in FIGS. 2 and 3. A male hinge device 30 is located in the center on the flat tail plane 29 where the plane emerges from the upper aft body section 28. This device is the male half of a hinge to which the tail assembly 46 is attached as shown in FIG. 8.

The tail assembly 46 location corresponds to the flat tail plane 29 on the upper aft body section 28. The tail assembly 46 comprises six components: a primary pygostyle 47, a secondary pygostyle 52, a precurved trailing edge dowell 56, a fabric tail cover 58, a hinge pin 57, and an elasticized member 60 as shown in FIG. 4.

The main component of the tail assembly 46 is the primary pygostyle 47. This structure serves as the component to which all other subassemblies are based. Incorporated into the forward section of this component is a female hinge part 48 which fits the male hinge part 30. The aft end of the primary pygostyle 47 is essentially a receptacle fashioned to accommodate the insertion of the secondary pygostyle 52 and it's assembled components as shown in FIG. 4.

The secondary pygostyle 52 is a structure with a lateral curved body shaped to fit adjacent to the flat aft curved receptacle surface of the primary pygostyle 47. Protruding perpendicular through the geometric center of the lateral secondary pygostyle 52 is a rod extending forward approximately one inch and aft approximately six inches. The forward rod extension 53 serves as a register pin to insure an exact and snug fit into a corresponding primary pygostyle socket 51. The aft end rod extension 54 serves as an insertion and extraction handle for the secondary pygostyle assembly 52.

Figure 4:
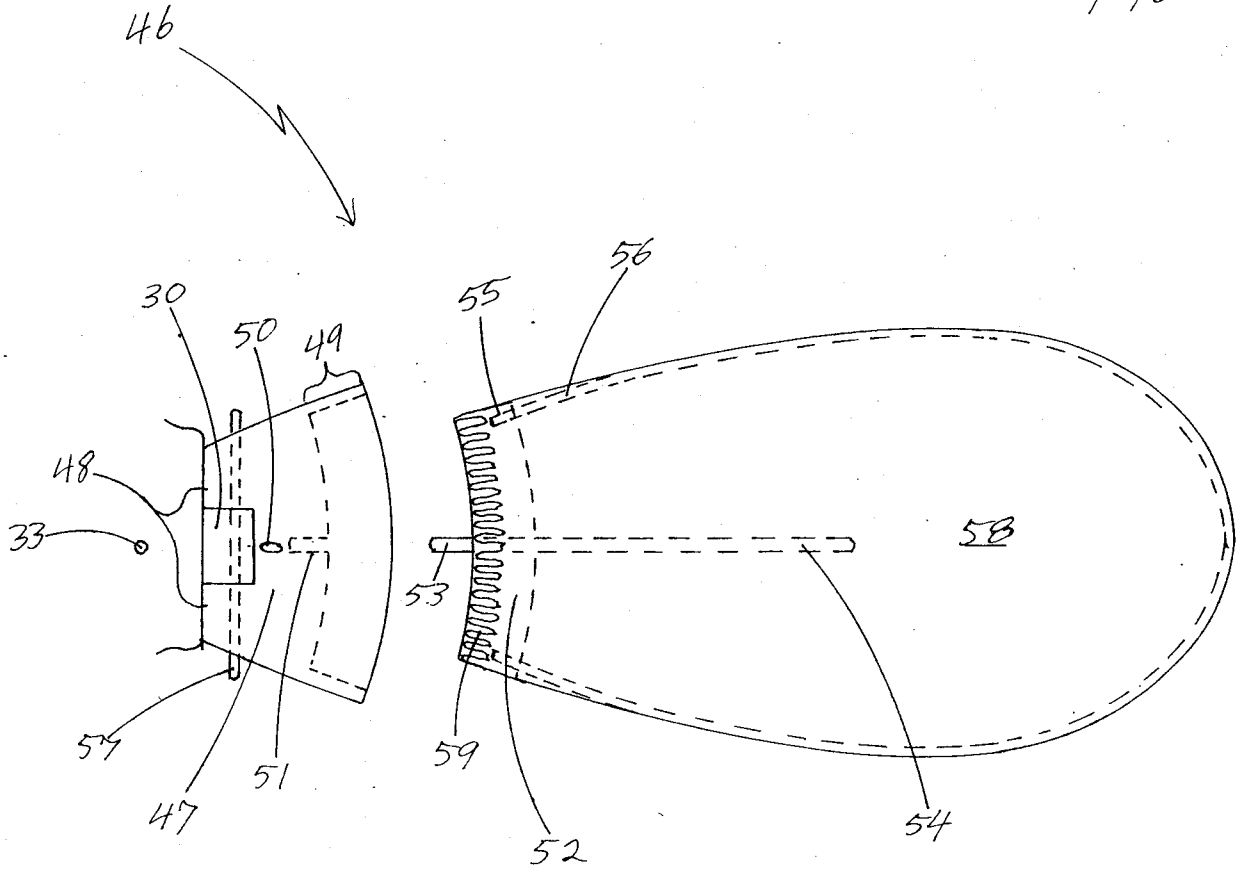
FIG. 4. A top fragmentary view of a hinged tail assembly partially exploded to illustrate the subassemblies.

The lateral curved secondary pygostyle 52 serves as the installation platform for the precurved trailing edge dowell 56 as illustrated in FIG. 4. This embodiment employs a one eigth inch diameter bass wood dowell approximately twenty four inches in length. Laterally splayed sockets 55 are located at the end of the seconday pygostyle 52 curved lateral structure. When the trailing edge dowell 56 ends are installed, one into each socket 55, the tail feather embodiment shape is established. The trailing edge dowell 56 ends fit easily into their respective sockets 55 and are mechanically stopped at approximately one half inch.

The fabric tail cover 58 is then pulled over the trailing edge dowell 56 and the extraction rod like a pillowcase cover. The open end 59 of the tail cover 58 is elasticized to secure a snug fit around the lateral axis of the secondary pygostyle 52 as shown in FIG. 4. When the secondary pygostyle 52 is inserted into the primary pygostyle 47 the front section of the secondary pygostyle 52 is enclosed by a collar 49 which protrudes rearward from the aft and of the primary pygostyle 47 a distance required to shield the elasticized end 59 of the fabric tail cover 58. The collar 49 serves to further eliminate drag while enhancing the artistic flow of the M/P kite 20. When the tail assembly 46 has been assembled, the hinge parts 30 and 48 are fitted and the hinge pin 57 is inserted.

Located on the top center of the primary pygostyle 47 immediately to the rear of the female hinge part 48 is a hookup device 50 which is used to connect an elasticized member 60. This in turn is hooked at the other end to a hookup device 33 located on the top center of the aft body section 28 a variable distance (approximately one inch ) rearward of the wing mount sockets 25 as shown in FIG. 3.

When the elasticized member 60 is installed, the complete tail assembly 46 rotates upward. The degree of arc is adjustable and can have a range of from zero to ninety degrees. The elasticized member 60 should have the expansion characteristics of a doubled "Ideal size thirty rubber band".

The ratio of the installed tail fabric cover 58 area to the fabric cover area of the wings 34 is proportional, in the case of this embodiment (a Japanse Crane) there are approximately six hundred and sixty square inches of wing area to fifty two square inches of tail area. This ratio of thirteen to one (13:1) may vary depending upon the embodiments; but should remain essentially in this ratio range.

The leg assembly 61 is comprised of a pair of footed legs 62. A line 63 is attached to and suspended between the legs 62. The leg assembly 61 is designed to be removably inserted into the leg mount sockets 31 of the aft body section 28 as illustrated in FIG. 1 and 3.

The line 63 tied to and suspended between the legs 62 is located a variable linear distance beyond the extreme rear of the aft body section 28. The harness assembly 65 attaches to this line 63 and is free to float between the leg assembly members to accommodate fluctuating wind conditions.

The leg assembly 61 is the agent for counterbalance, center of gravity, landing and as the hookup point 72 for the harness assembly 65. Depending upon the embodiment portrayed and with variables particular to certain bird groups, license with leg length and counterbalance must be incorporated. For example, a bird such as a crane has long legs which extend rearward when in flight. These legs accommodate a natural portrayal of the bird while at the same time provide the functions mentioned above. Other embodiments, such an eagle or toucan which have shorter legs require in some cases, a counterbalance 64 in conjunction with the leg assembly 61. This counterbalance 64 is usually a rod approximately one quarter of an inch thick. When removably inserted into the counterbalance socket 32 of the aft body section 28 it extends rearward a variable length (approximately twenty inches) in a straight line as illustrated in FIG. 8. The counterbalance rod 64, if essential, serves as the hookup point 73 for the aft end of the harness assembly 65 as illustrated in FIG. 8 depicting a shorter legged embodiment.

The harness assembly 65 is comprised of a main harness line 66 which is approximately twenty inches long, a fulcrum 67 which is a pierced solid piece, and an elasticized member 68 as shown in FIGS. 1 and 3. The elasticized member 68 is preferrably a "Goody braided elastic ponytail holder" or a doubled "Ideal size thirty rubber band". The fulcrum 67 is located on and threaded by the main harness line 66 and can be fixed at any position along the main harness line 66.

The fulcrum 67 is the point of hookup to the main flight line 70 as shown in FIG. 3. The fulcrum 67 is also the mechanical factor in establishing the attack angle of the M/P kite 20 in flight. With the fulcrum 67 installed, the harness assembly 65 is attached at the extreme forward point 71 of the central body 21, in this embodiment it is the beak. The aft end of the elasticized member 68 is attached to the hookup point 72 of the leg assembly 61 as indicated above or attached to the hookup point 73 of the counterbalance rod 64 as dictated by shorter leg embodiments. When held with the longitudinal axis of the assembled kite 20 parallel to the horizontal axis there should be at least a three inch sag in the harness assembly 65 when installed.

When all assemblies have been fashioned and the kite 20 has been assembled, flight preparations can be made. Embodiments must be prepared individually and in accord with prevailing wind conditions. The first adjustment calls for the establishment of the attack angle of the kite 20 while in flight. As stated earlier, the primary means to set this angle is the fulcrum 67. The fulcrum 67 is preliminarily situated along the main harness line 66 such that when slight tension is exerted forward and at approximately a forty five degree angle to the horizontal axis, and with equal tension exerted on the front and aft ends of the harness assembly 65, the attack angle of the kite 20 should be approximately ten degrees relative to the horizontal axis.

The tail assembly 46 is the next adjustment to be made and this is accomplished by rotating the installed tail assembly 46 to the up position and connecting the elasticized member 60 to its respective hookup points 33 and 50. As was stated earlier, this movement travels through an arc and can have a range of from zero to ninety degrees. With this particular embodiment ( a Japanese Crane), the flight mode angle is established at approximately seventy degrees.

The next components are the wind streamers 69. There are two one for each wing 34 as shown in FIG. 1. The streamers 69 are situated along the trailing edge 43 and serve two purposes; they enable exact balance and provide drag stability for the kite 20.

When the M/P kite 20 is launched it backs up and away relative to wind velocity. When the desired altitude is reached the kite 20 can be anchored. The kite 20 naturally settles into the wind and soars like a real bird. Tension on the main flight line 70 decreases and thereafter merely acts to hold the soaring kite 20 in place.

The elasticized members 68 and 60 which are associated with the harness assembly 65 and the tail assembly 46 work in concert to provide attack angle flexibility of the kite 20 in flight. The design of the kite 20 allows for a range of altitudes of from fifty feet to beyond official FAA restrictions, while constantly adjusting its flight attitude to accommodate all reasonable stress of flight.

All structural and artistic components of the M/P kite 20 are fashioned from balsa wood, bass wood dowells and silk; stress points such as sockets and the male hinge part 30 are reenforced with reed inserts. Cutout wood feathers are applied to the kite 20 from the rearmost point of the central body 21 to where the beak emerges from the head. These feathers are applied in the same fashion as shingles are applied to a roof. They work in conjunction with an internal skeletal structure to establish an exoskeleton which creates the body form, feather embodiments, and ensures structural integrity and rigidity. The beak is a finely sanded projection which is reenforced by the lamination of several layers of appropriately dyed silk. The silk laminates are sanded to a high polish and then coated with clear polyurethane lacquer. Taxidermist grade, glass bird eyes are installed into previously cut eye sockets.

The fabric covers for both the wing assembly 35 and the tail assembly 46 are made of china silk. Feather characteristics on the fabric covers are accomplished by using ink and wood block printing techniques. Coloration of the body and wings with appropriate colors are done in the interest of artistic accuracy. The preferred main flight line is twenty pound test spun nylon fly fish line. This fully assembled flight ready kite 20 embodiment weighs thirteen and five eigths ounces.

Although the M/P kite 20 is made from natural materials, lightweight plastics can be used for structure and shape just as fabric covers can be fashioned from lightweight silk like fabrics.

I claim:

1. A kite comprising:

a rigid central body extending longitudinally and formed of lightweight material;

two pair of rigid wing mount structures at shoulder level set perpendicular to said longitudinal axis and extending from the core of said central body;

two wing mount collars, each said wing mount collar projecting from said central body and extending in a direction substantially parallel to said longitudinal axis;

a pair of wings, each said wing comprised of a three dimensional wing frame assembly, fabric cover, and a means to removably mount said wings into said wing mount structures;

a hinge member disposed on the aft section of said central body;

a tail assembly comprised of lightweight rigid material, fabric tail cover, hinge member and an elasticized member;

the lower aft section of said central body forming mounting devices;

counterbalance structures which can be removably mounted to said lower aft section mounting devices; and an elasticized harness assembly comprised of a fulcrum structure.

2. A kite as claimed in claim 1, in which each said wing frame assembly is comprised of a rigid primary wing frame which conforms, in cross section, to a standard airfoil configuration along an ascending curve and to an inverted airfoil configuration along a countercurve;

a rigid fillet which is perpendicularly joined to said primary wing frame; and a flexible trailing edge member, the ends of which are adapted to be removably fit to said primary wing frame and said fillet.

3. A kite as claimed in claim 2, in which said fillet comprises mounting devices to removably mount said wings to said wing mount structures.

4. A kite as claimed in claim 1, in which said fabric covers are fitted pillowcase like coverings.

5. A kite as claimed in claim 4, in which said fabric covers have elasticized open ends.

6. A kite as claimed in claim 1, in which said tail assembly can be removably mounted to said central body by said hinge members.

7. A kite as claimed in claim 6, in which said tail assembly is held in a flight position by said tail assembly elasticized member.

8. A kite as claimed in claim 1, in which said elasticized harness assembly can be removably attached to said central body and said counterbalance structures.

* * * * *